US009962858B2

(12) United States Patent
Chang

(10) Patent No.: US 9,962,858 B2
(45) Date of Patent: May 8, 2018

(54) CERAMIC AND MASONRY POWER SAW

(71) Applicant: Chin-Chin Chang, Taichung (TW)

(72) Inventor: Chin-Chin Chang, Taichung (TW)

( * ) Notice: Subject to any disclaimer, the term of this patent is extended or adjusted under 35 U.S.C. 154(b) by 275 days.

(21) Appl. No.: 14/929,712

(22) Filed: Nov. 2, 2015

(65) Prior Publication Data

US 2017/0120477 A1 May 4, 2017

(51) Int. Cl.
*B28D 1/04* (2006.01)
*B28D 7/02* (2006.01)
*B28D 7/04* (2006.01)

(52) U.S. Cl.
CPC ..... *B28D 1/047* (2013.01); *B28D 1/04* (2013.01); *B28D 7/02* (2013.01); *B28D 7/04* (2013.01)

(58) Field of Classification Search
CPC . B28D 1/04; B28D 1/047; B28D 7/02; B28D 7/04
USPC ..... 451/342, 449; 125/13.01
See application file for complete search history.

(56) References Cited

U.S. PATENT DOCUMENTS 5,676,124 A * 10/1997 Lee ..... B28D 1/047 125/13.01
6,000,387 A * 12/1999 Lee ..... B23D 47/025 125/11.22
6,283,110 B1 * 9/2001 Lee ..... B23D 47/025 125/13.01
6,679,244 B1 * 1/2004 Tsao ..... B28D 1/047 125/13.01
7,494,149 B2 * 2/2009 Liu ..... B25H 1/04 280/30
8,656,902 B2 * 2/2014 Wei ..... B23D 47/025 125/12
9,630,343 B2 * 4/2017 Vikholm ..... B28D 7/02
2002/0162548 A1 * 11/2002 Lee ..... F41B 5/1426 124/89
2007/0197139 A1 * 8/2007 Wise ..... B23D 57/0092 451/41
2014/0261367 A1 * 9/2014 Ipatenco ..... B28D 1/04 125/13.01

* cited by examiner

*Primary Examiner* — Eileen Morgan

(57) ABSTRACT

A ceramic and masonry power saw includes a cutting head assembly including a circular saw blade, an electric motor for driving the saw blade, and a support member for supporting both the saw blade and the motor; a rectangular box shaped frame including two hollow members at front and rear ends respectively, two side members interconnecting the end members, two side supports interconnecting the end members, a tray removably disposed on the frame by passing through the hollow member, and a first coolant pan communicating with the tray; a rail assembly disposed on the frame; and a cutting table including a main platform slidably disposed on the rail assembly, an auxiliary platform secured to one side of the main platform, and a second coolant pan releasably secured to the main platform.

4 Claims, 12 Drawing Sheets

CERAMIC AND MASONRY POWER SAW

BACKGROUND OF THE INVENTION

1. Field of the Invention

The invention relates to ceramic and masonry power saws and more particularly to a ceramic and masonry power saw having improved characteristics.

2. Description of Related Art

U.S. Pat. No. 5,676,124 to Lee discloses a ceramic and masonry power saw comprising a cutting table attached to a frame; a cutting head having a proximal end and a distal end, supported above the table and attached to the frame at a proximal end; a motor attached to the cutting head; a tapered bearing housing assembly disposed in the cutting head at the distal end; a circular saw blade connected to the tapered bearing housing assembly; a drive belt connected to the motor and the circular saw blade immediately adjacent thereto; and a tray disposed beneath the cutting table. The cutting table includes a hinge member connected to the frame, whereby the cutting table pivots around the frame.

However, in a cutting operation, coolant and saw dust are mixed and the mixture may splash out of the cutting table. The splash may disperse dirt on an employee and pollute the environment.

Thus, continuing improvements in the exploitation of ceramic and masonry power saw of this type are constantly sought.

SUMMARY OF THE INVENTION

It is therefore one object of the invention to provide a ceramic and masonry power saw comprising a cutting head assembly including a circular saw blade, an electric motor for driving the saw blade, and a support member for supporting both the saw blade and the motor; a rectangular box shaped frame including two hollow members at front and rear ends respectively, two side members interconnecting the end members, two side supports interconnecting the end members, a tray configured to removably dispose on the frame by passing through the hollow member, and a first coolant pan communicating with the tray; a rail assembly disposed on the frame; and a cutting table including a main platform slidably disposed on the rail assembly, an auxiliary platform secured to one side of the main platform, and a second coolant pan releasably secured to the main platform.

The above and other objects, features and advantages of the invention will become apparent from the following detailed description taken with the accompanying drawings.

DETAILED DESCRIPTION OF THE INVENTION

Figure 1:
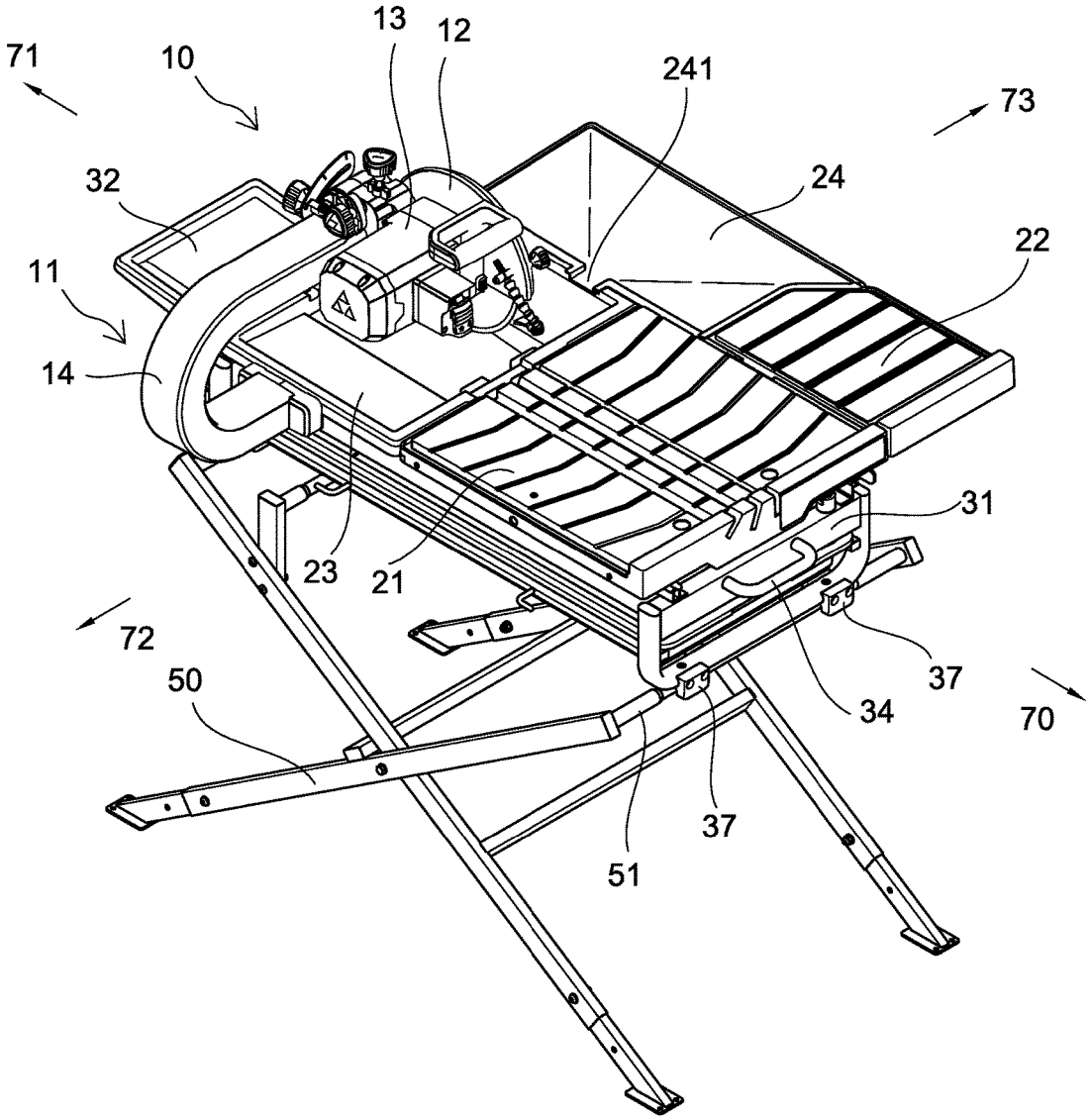
FIG. 1 is a perspective view of a ceramic and masonry power saw according to the invention.
Figure 2:
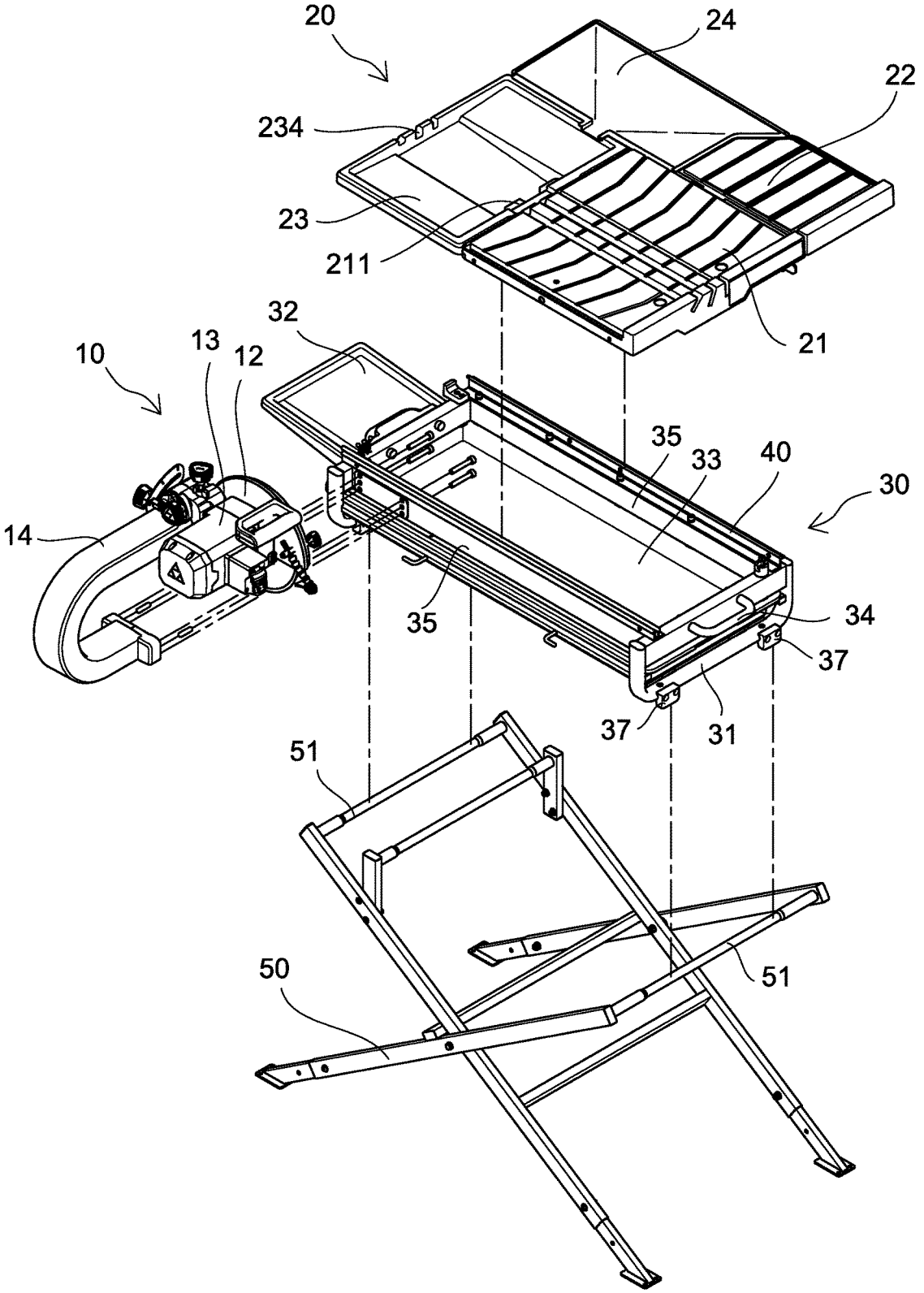
FIG. 2 is an exploded view of FIG. 1.
Figure 3:
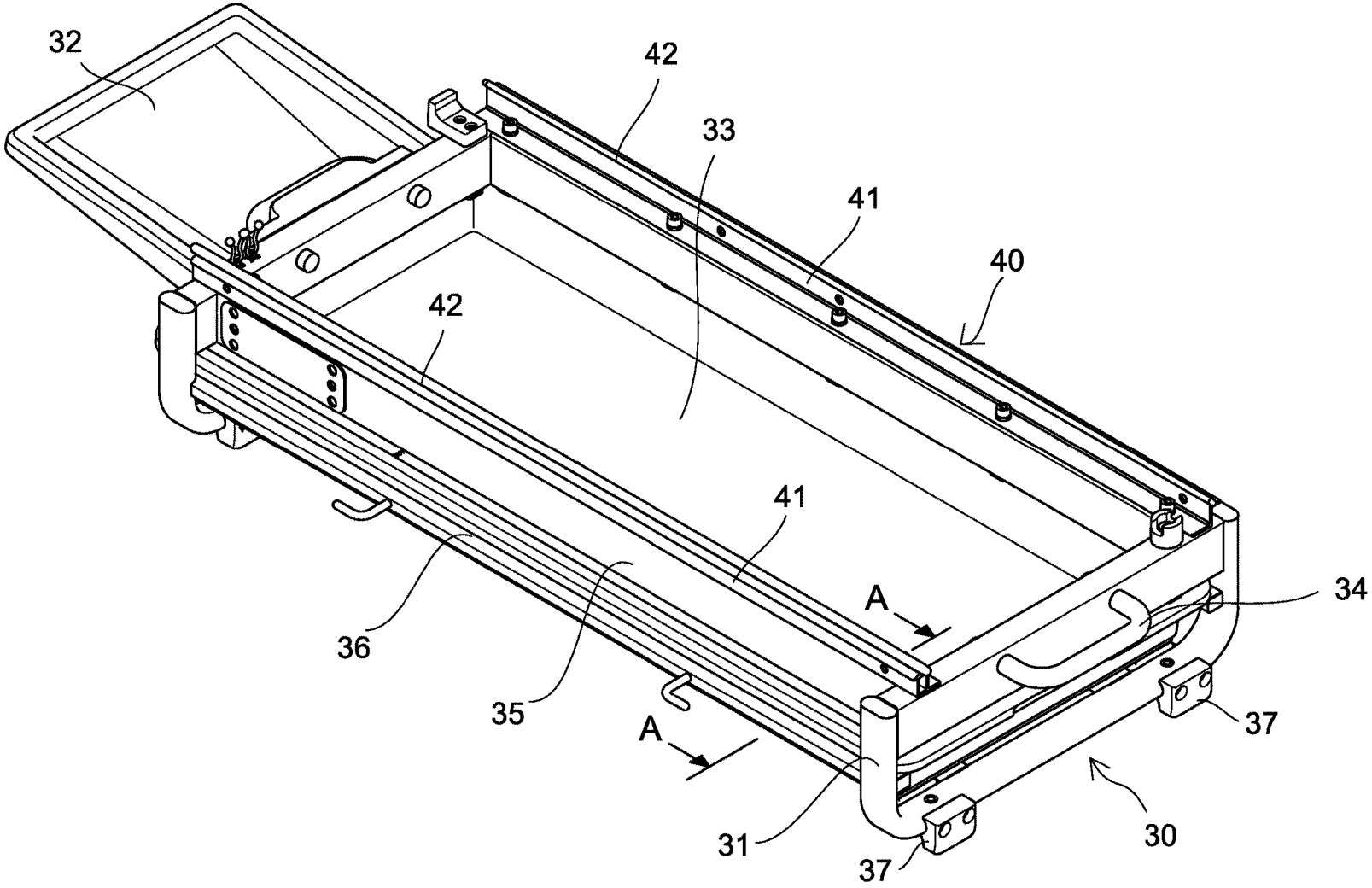
FIG. 3 is a perspective view of the frame and the rail assembly.
Figure 3A:
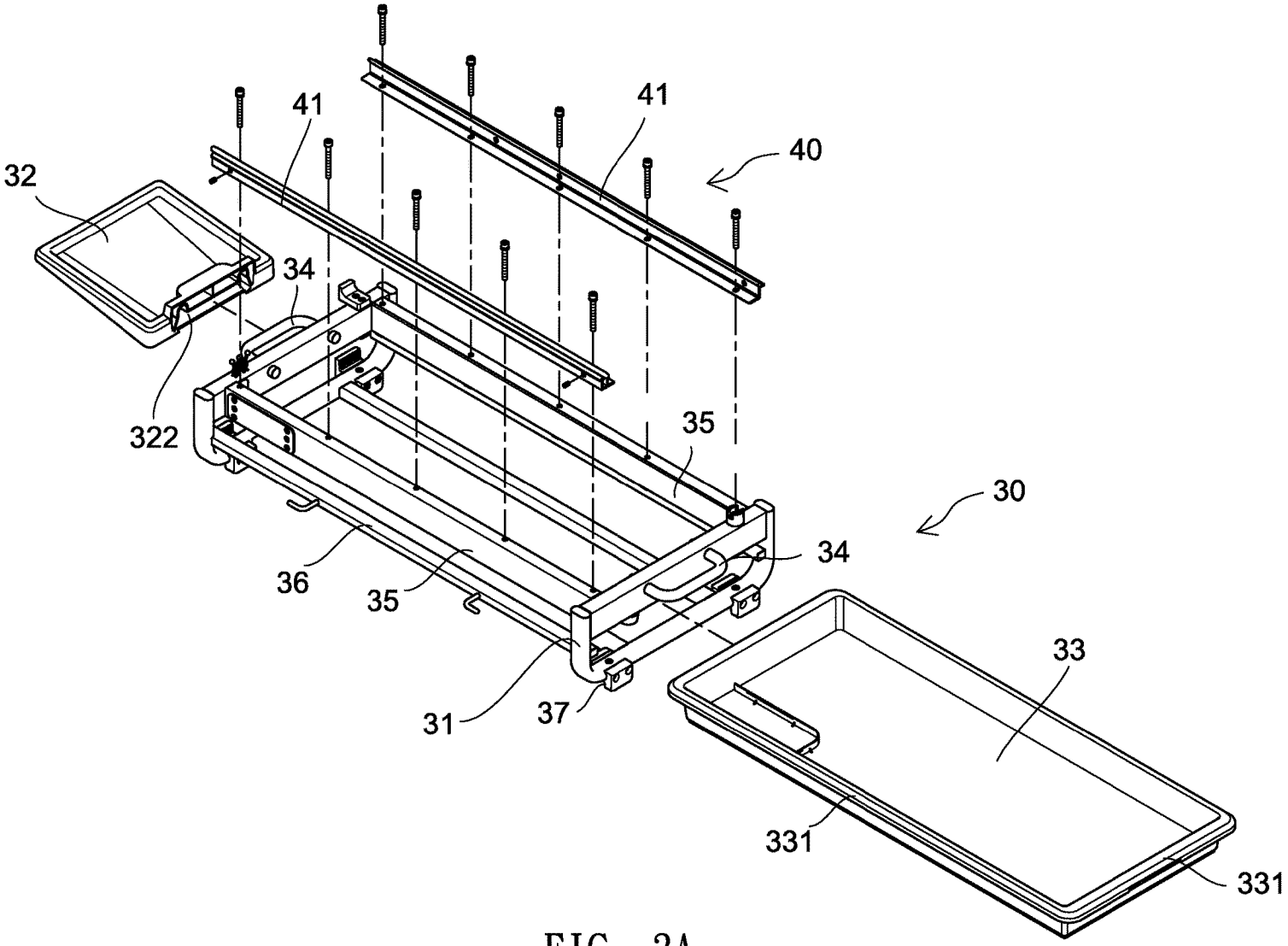
FIG. 3A is an exploded view of FIG. 3.
Figure 4:
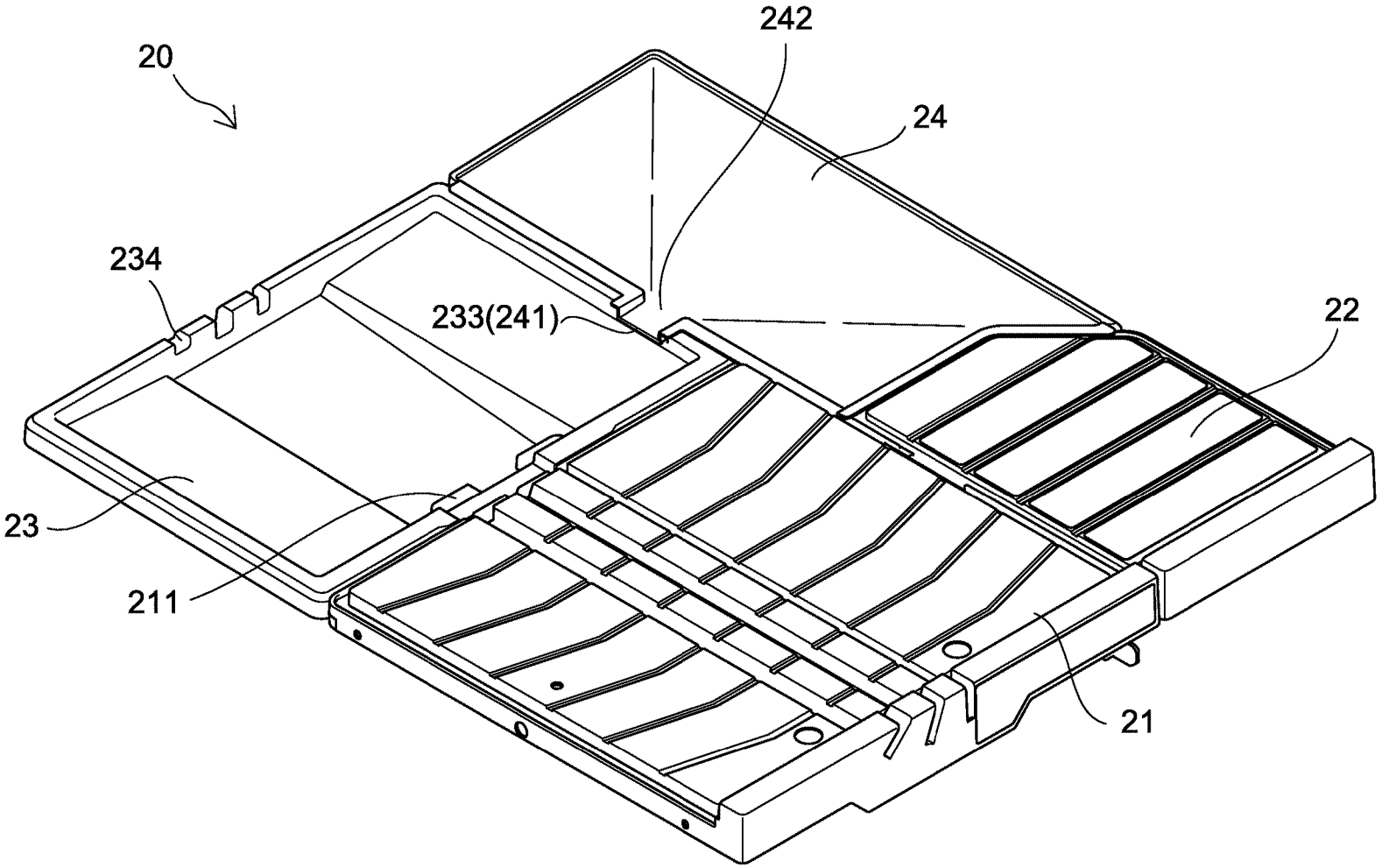
FIG. 4 is a perspective view of the cutting table.
Figure 5:
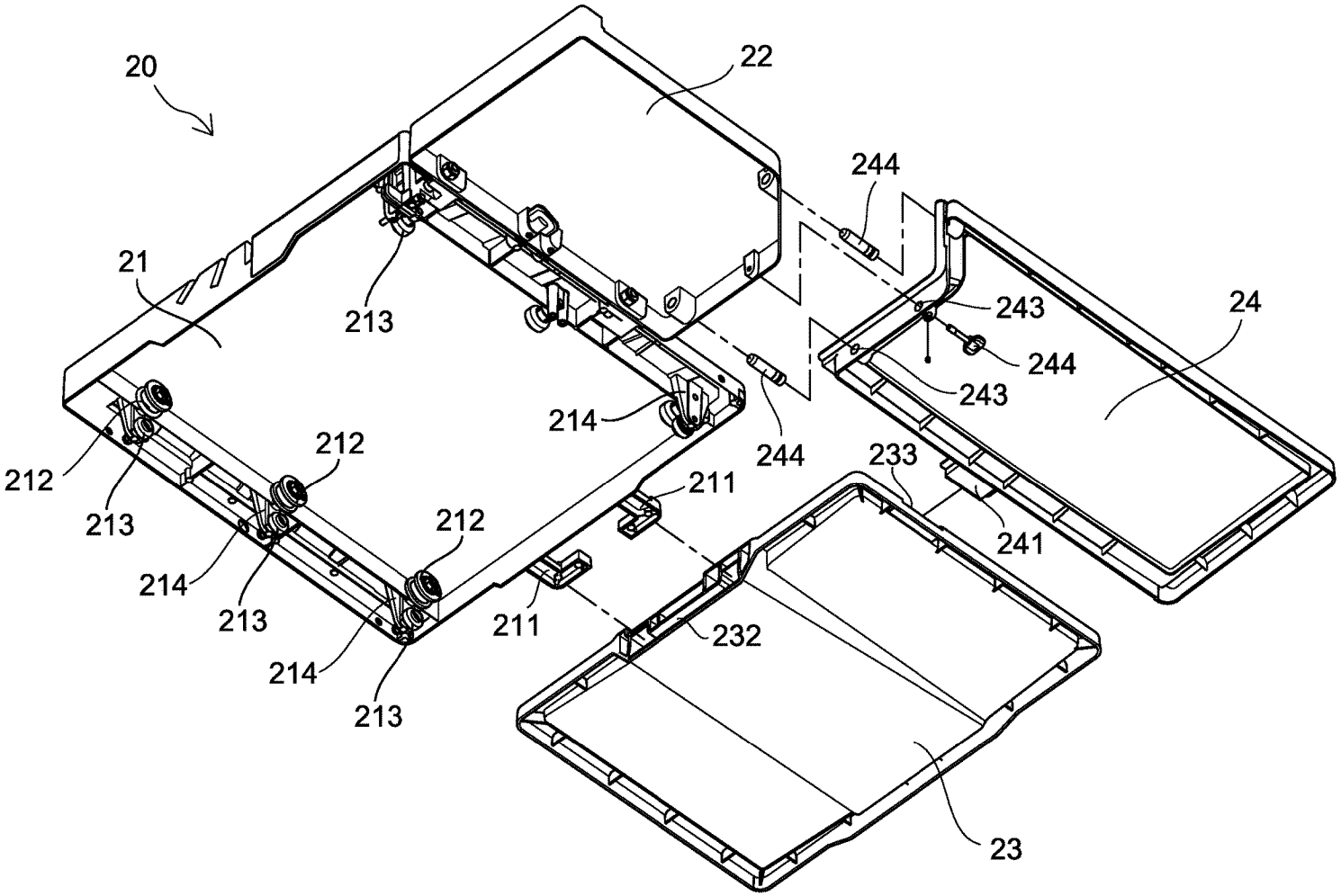
FIG. 5 is an exploded view of FIG. 4.

Referring to FIGS. 1 to 9, a ceramic and masonry power saw in accordance with the invention comprises the following components as discussed in detail below.

Front, rear, one side, and the other side of cutting head assembly 10 are designated by reference numerals 70, 71, 72, and 73 respectively.

The cutting head assembly 10 includes a circular saw blade 12, an electric motor 13 for driving the saw blade 12, and a support member 14 for supporting both the saw blade 12 and the motor 13. Two U-shaped folding support legs 50 are pivotably secured together. Each support leg 50 has a cross member 51. A rectangular box shaped frame 30 includes two hollow members 31 at front and rear ends respectively, two side members 36 interconnecting the end members 31, two side supports 35 also interconnecting the end members 31, four positioning members 37 at four corners of a bottom respectively, the positioning members 37 being seated on the cross members 51 to position the frame 30 on the support legs 50, two handles 34 at front and rear ends respectively, a first coolant pan 32 having a hole 322 for securing the first coolant pan 32 to the handles 34 of the rear end of the frame 30, a gap being formed between the first coolant pan 32 and the hole 322 so that coolant can flow out of the first coolant pan 32, and a tray 33 having an outward extending lip 331 engaging a top of the side member 36 and configured to removably dispose on the frame 30 by passing through the hollow member 31.

A rail assembly 40 includes two parallel bars 42, two bases 41 secured to the bars 42 respectively, each base 41 having a guide flange 411 on one side, a plurality of fasteners 45 driven through the bases 41 into the side supports 35 for fastening them together, and two adjustment screws 44 each driven through the base 41 for threadedly adjusting a distance between the fastener 45 and the base 41. A cutting table 20 includes a main platform 21 having two latches 211 at a rear end, a plurality of support elements 214 on two sides of a bottom of the main platform 21 respectively, a plurality of upper rollers 212 on the support element 214 for slidably moving on the bars 42, and a plurality of lower rollers 213 on the bottom of the support element 214 and under the upper rollers 212 for allowing the main platform 21 to slidably move thereon, the lower roller 213 having an extension 2131 sliding on an underside of the guide flange 411; an auxiliary platform 22 secured to one side of the main platform 21, a second coolant pan 23 having two rear slots 232 for releasably securing the auxiliary platform 22 to the latches 211 with a gap formed between the slot 232 and the latch 211 for draining purpose, a recess 233 at the other side, and a plurality of rear outlets 234; and a third coolant pan 24 having a side latch 241 releasably secured to the recess 233, an outlet 242 on a top directly above the side latch 241, a plurality of through holes 243 on a front end, and a plurality of fasteners 244 inserted through the through holes 243 to secure the third coolant pan 24 and the auxiliary platform 22 together. Thus, the cutting table 20 consists of the main platform 21, the auxiliary platform 22, the second coolant pan 23, and the third coolant pan 24 and is shaped as a rectangle.

Figure 6:
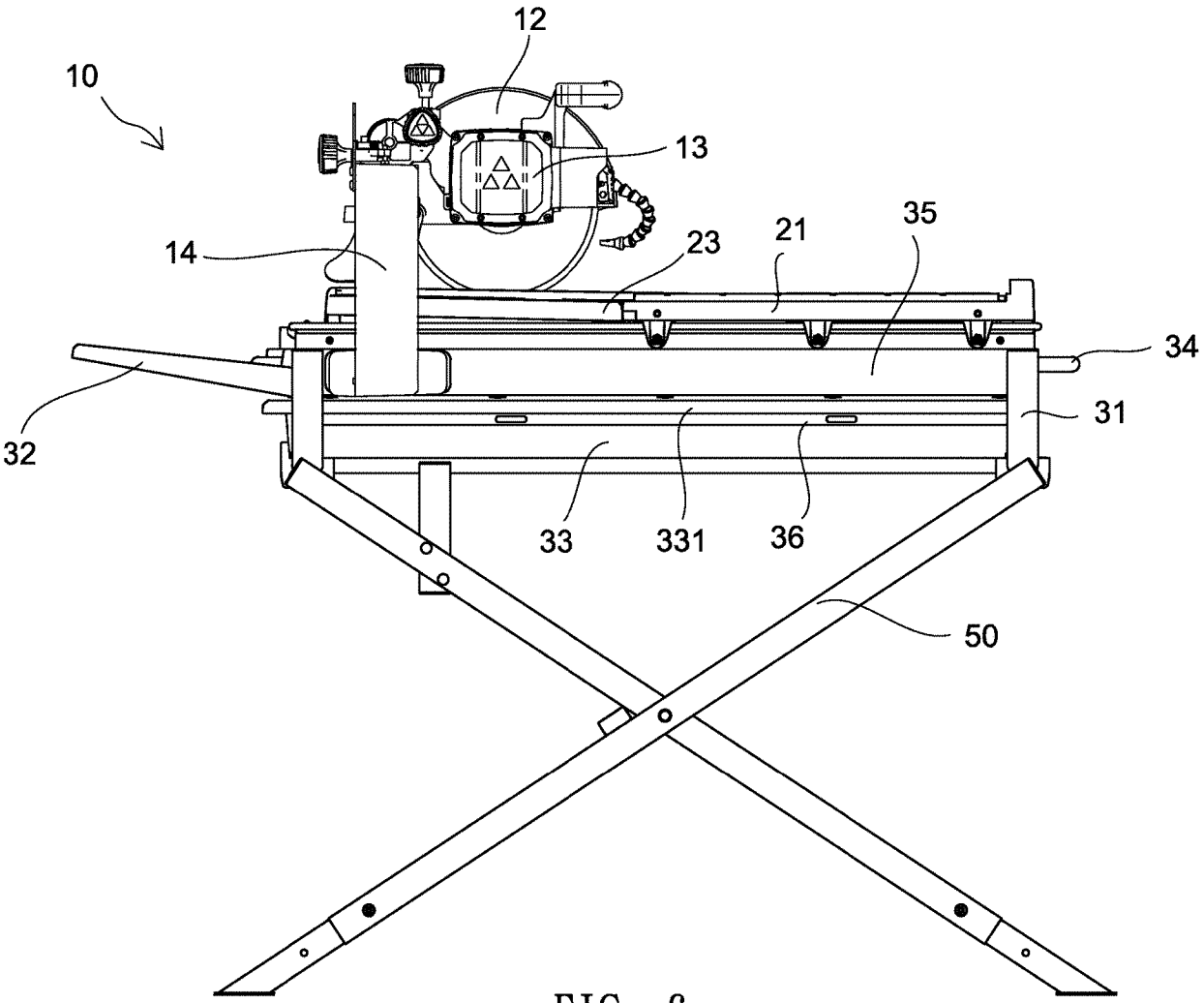
FIG. 6 is a side elevation of FIG. 1.
Figure 6A:
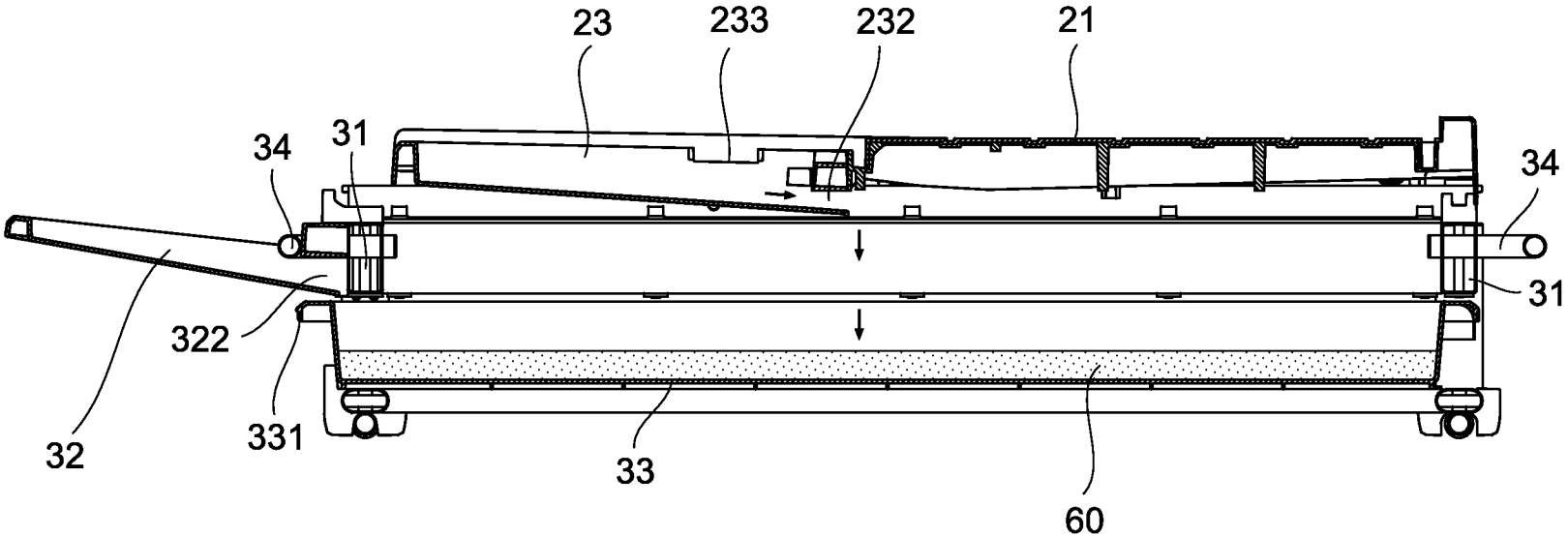
FIG. 6A is a longitudinal sectional view of the frame and the rail assembly and the cutting table of FIG. 6 showing the path of coolant flow in a cutting operation.
Figure 7:
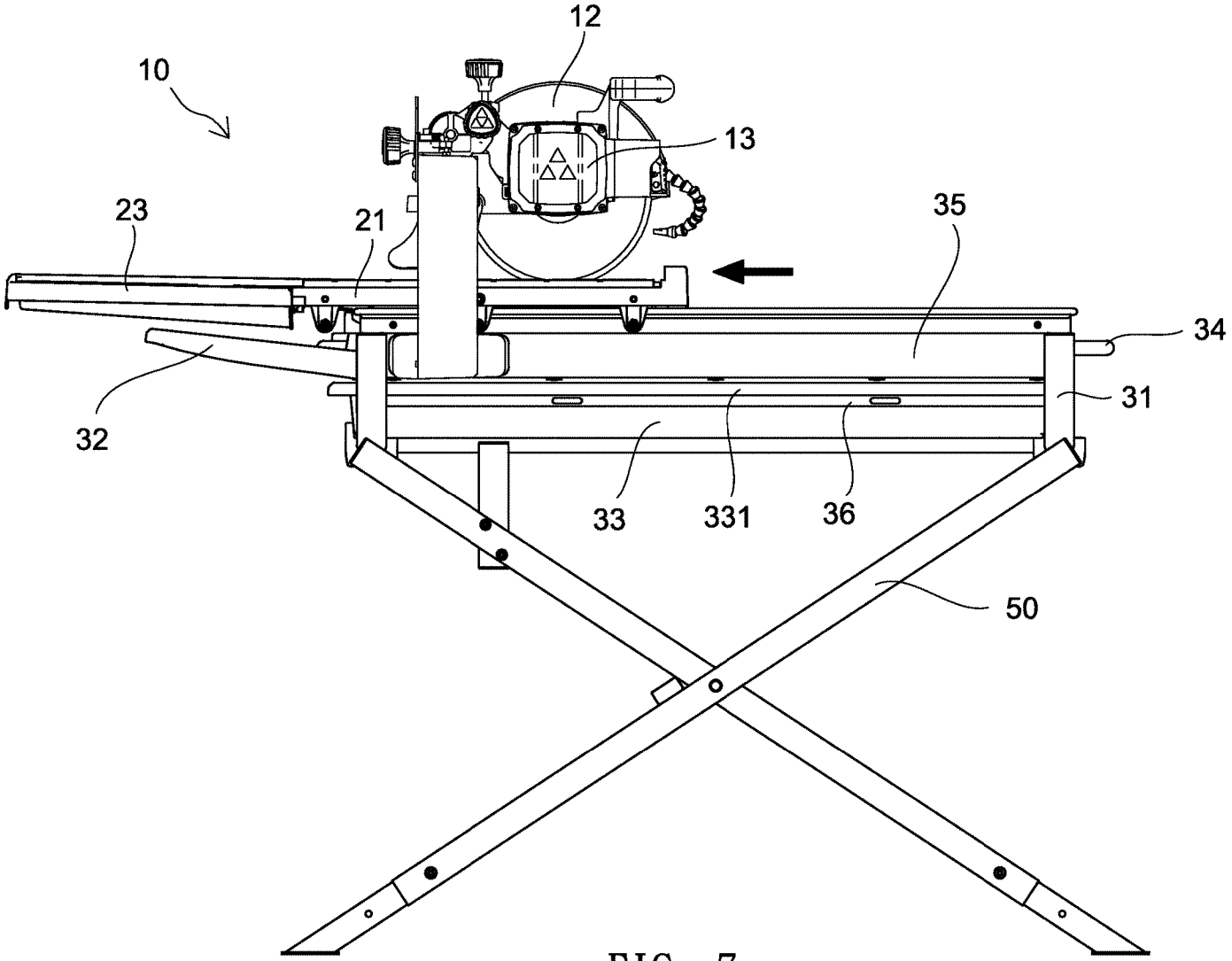
FIG. 7 is a view similar to FIG. 6 showing a leftward movement of the cutting table in the cutting operation.
Figure 7A:
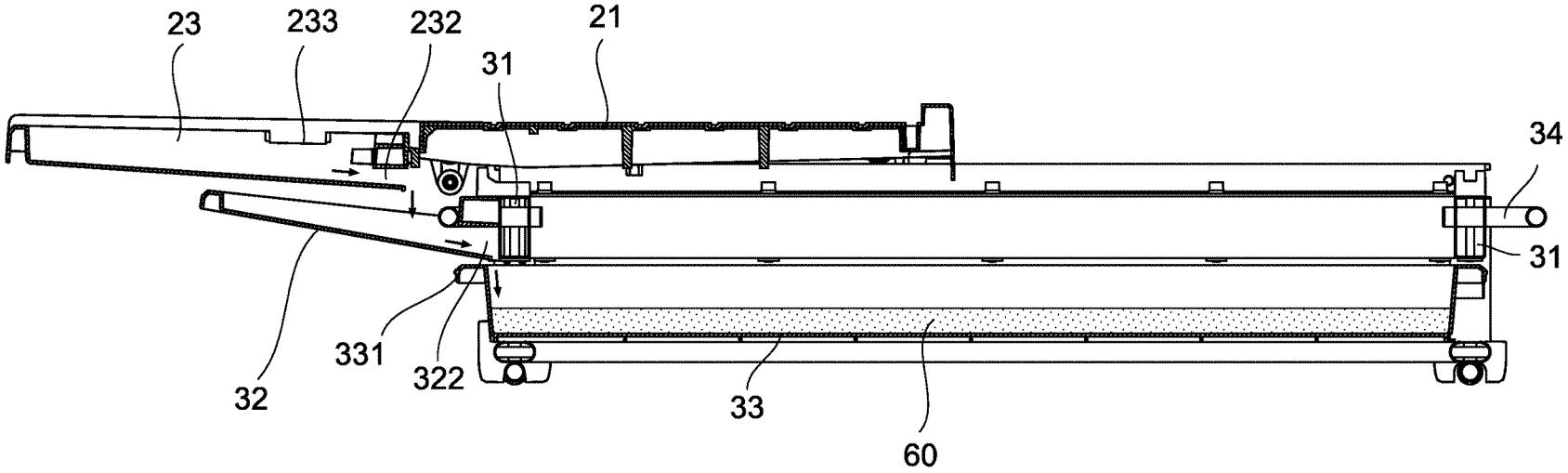
FIG. 7A is a longitudinal sectional view of the frame and the rail assembly and the cutting table of FIG. 7 showing the path of coolant flow in the cutting operation.
Figure 8:
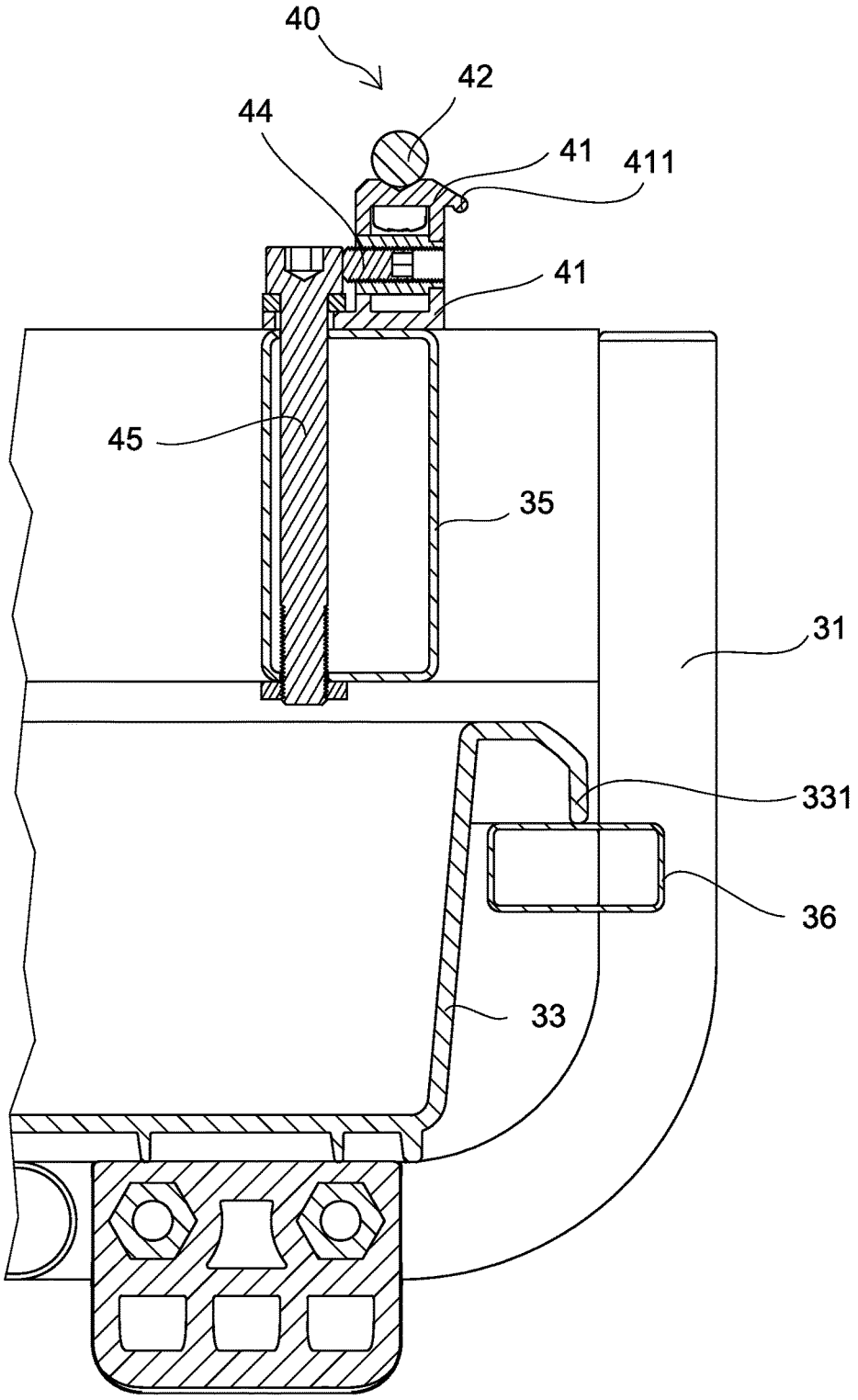
FIG. 8 is a sectional view taken along line A-A of FIG. 3.
Figure 9:
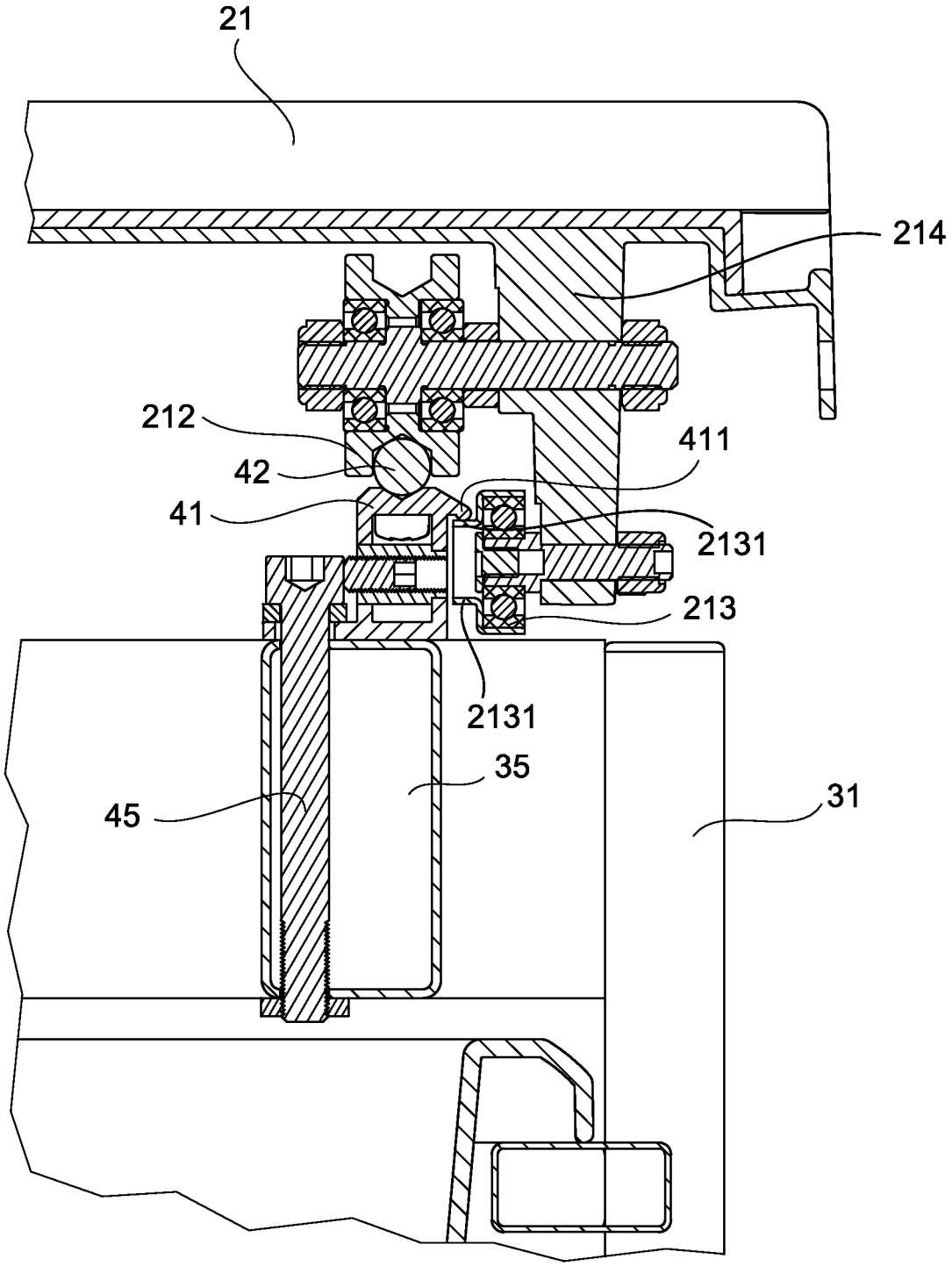
FIG. 9 is a view similar to FIG. 8 showing the main platform, the rollers, and the rail assembly.

Operations of the invention are described in detail below. A work piece (e.g., ceramic tile or brick) is placed on the main platform 21 by a user. Next, the user may slide the platform 21 by moving the rollers 212 over the bars 42 to either move the work piece under the saw blade 12 to be ready to cut or move the work piece out of the saw blade 12 after finishing the cutting. In one state, coolant in the second coolant pan 23 flows through the rear slots 232 to the tray 33. And in turn, the coolant mixes with saw dust 60 prior to flushing away the saw dust 60 (see FIG. 6A). In the other state, the coolant in the second coolant pan 23 flows through the outlets 234 to the first coolant pan 32. And in turn, the coolant in the first coolant pan 32 flows through the hole 322 to the tray 33. The coolant in the tray 33 mixes with the saw dust 60 prior to flushing away the saw dust 60 (see FIG. 7A).

Advantageously, in a cutting operation, a mixture of coolant and saw dust is prevented from splashing to disperse dirt on an employee and pollute the environment due to the fastening of the latches 211 of the main platform 21 in the rear slots 232 of second coolant pan 23.

Coolant in the third coolant pan 24 may flow through the outlet 242 to the second coolant pan 23. And in turn, the coolant flows through the rear slots 232 to leave the second coolant pan 23. Moreover, the motor 13 may activate a pump (not shown) to pump coolant from a cooling source (not shown) or from the tray 33 and the coolant is impinged the saw blade 12 for cooling purpose.

While the invention has been described in terms of preferred embodiments, those skilled in the art will recognize that the invention can be practiced with modifications within the spirit and scope of the appended claims.

What is claimed is:

1. A ceramic and masonry power saw comprising:

a cutting head assembly (10) including a circular saw blade (12), an electric motor (13) for driving the saw blade (12), and a support member (14) for supporting both the saw blade (12) and the motor (13);

a rectangular box shaped frame (30) including two hollow members (31) at front and rear ends respectively, two side members (36) interconnecting the hollow members (31), two side supports (35) interconnecting the hollow members (31), a tray (33) configured to removably dispose on the frame (30) by passing through the hollow member (31), and a first coolant pan (32) communicating with the tray (33);

a rail assembly (40) including two parallel bars (42), two bases (41) secured to the bars (42) respectively, each base (41) having a guide flange (411) on one side, a plurality of fasteners (45) driven through the bases (41) into the side supports (35) to fasten the bases (41) and the side supports (35) together, and two adjustment screws (44) each driven through the base (41) for threadedly adjusting a distance between the fastener (45) and the base (41); and a cutting table (20) including a main platform (21) slidably disposed on the rail assembly (40), an auxiliary platform (22) secured to one side of the main platform (21), and a second coolant pan (23) releasably secured to the main platform (21).

2. The ceramic and masonry power saw of claim 1, further comprising two folding support legs (50) pivotably secured together, each support leg (50) having a cross member (51), and wherein the frame (30) further comprises four positioning members (37) at four corners of a bottom thereof respectively, the positioning members (37) being seated on the cross members (51) to position the frame (30) on the support legs (50).

3. The ceramic and masonry power saw of claim 1, wherein the frame (30) further comprises two handles (34) at front and rear ends respectively, wherein the first coolant pan (32) has a hole (322) placed on one of the handles (34) at the rear end of the frame (30) for securing the first coolant pan (32) to the handle (34) at the rear end of the frame (30) so that the coolant is configured to flow out of the first coolant pan (32) to a dap between the first coolant pan (32) and the hole (322).

4. The ceramic and masonry power saw of claim 1, wherein the cutting table (20) further comprises two latches (211) at a rear end of the main platform (21), a plurality of upper rollers (212) each on a support element (214) for slidably moving on the bars (42), and a plurality of lower rollers (213) each on a bottom of the support element (214) and under the upper roller (212) for allowing the main platform (21) to slidably move thereon, the lower roller (213) having an extension (2131) sliding on an underside of the guide flange (411); an auxiliary platform (22) secured to one side of the main platform (21), two rear slots (232) for releasably securing the auxiliary platform (22) to the latches (211) with a gap formed between the each slot (232) and each latch (211), a recess (233) at the other side of the main platform (21), and a plurality of rear outlets (234), and a third coolant pan (24) having a side latch (241) relesably secured to the recess (233), an outlet (242) on a top directly above the side latch (241), a plurality of through holes (243) on a front end, and a plurality of fasteners (244) inserted through the through holes (243) to secure the third coolant pan (24) and the auxiliary platform (22) together, wherein the third coolant pan (24) communicates with the second coolant pan (23) through the outlet (242); and wherein in one state, the coolant in the second coolant pan (23) flows through the rear slots (232) to the tray (33), and in the other state, the coolant in the second coolant pan (23) flows through the rear outlets (234) to the first coolant pan (32), and the coolant in the first coolant pan (32) flows through the hole (322) to the tray (33).

* * * * *